US010582314B2

(12) United States Patent
Pedersen et al.

(10) Patent No.: US 10,582,314 B2
(45) Date of Patent: Mar. 3, 2020

(54) HEARING DEVICE COMPRISING A WIRELESS RECEIVER OF SOUND

(71) Applicant: Oticon A/S, Smørum (DK)

(72) Inventors: Michael Syskind Pedersen, Smørum (DK); Jesper Jensen, Smørum (DK); Svend Oscar Petersen, Smørum (DK); Anders Thule, Smørum (DK)

(73) Assignee: Oticon A/S, Smørum (DK)

( * ) Notice: Subject to any disclaimer, the term of this patent is extended or adjusted under 35 U.S.C. 154(b) by 6 days.

(21) Appl. No.: 15/915,322

(22) Filed: Mar. 8, 2018

(65) Prior Publication Data

US 2018/0262847 A1 Sep. 13, 2018

(30) Foreign Application Priority Data

Mar. 9, 2017 (EP) ..... 17160209

(51) Int. Cl.
*H04R 25/00* (2006.01)

(52) U.S. Cl.
CPC ..... *H04R 25/407* (2013.01); *H04R 25/405* (2013.01); *H04R 25/505* (2013.01); *H04R 25/554* (2013.01); *H04R 2225/55* (2013.01)

(58) Field of Classification Search
CPC ..... H04R 25/43; H04R 25/55; H04R 25/552; H04R 25/405; H04R 25/407
See application file for complete search history.

(56) References Cited

U.S. PATENT DOCUMENTS 6,694,034 B2 * 2/2004 Julstrom ..... H04R 25/43 381/315
7,020,296 B2 * 3/2006 Niederdrank ..... H04R 25/453 381/312

(Continued)

FOREIGN PATENT DOCUMENTS

EP 2 999 235 A1 3/2016
EP 3 101 919 A1 3/2016
EP 3 057 340 A1 8/2016

*Primary Examiner* — Curtis A Kuntz
*Assistant Examiner* — Ryan Robinson
(74) *Attorney, Agent, or Firm* — Birch, Stewart, Kolasch & Birch, LLP

(57) ABSTRACT

A hearing device, e.g. a hearing aid, adapted for being located at or in an ear of a user and/or for being fully or partially implanted in the head of the user, comprises

- A multitude of input units each providing an electric input signal representing a mixture of an audio signal from an audio signal source and possibly acoustic signals from other acoustic signal sources around the hearing device as received at the input unit in question;
- A wireless receiver for receiving and providing a direct representation of the audio signal;
- A beamformer filtering unit configured to receive said multitude of electric input signals, and providing a beamformed signal;
- A combination unit for providing a mixed signal comprising a combination of said direct representation of the audio signal and said beamformed signal, or signals originating therefrom;
- An output unit for presenting stimuli perceivable to the user as sound based on said mixed signal.

The beamformer filtering unit comprises an audio signal cancelling beamformer configured to provide that sound from the direction from the hearing device to the audio signal source is cancelled or attenuated compared to other (Continued)

directions in said beamformed signal. The application further relates to a method of operating a hearing device.

20 Claims, 8 Drawing Sheets

(56) References Cited

U.S. PATENT DOCUMENTS

| | | | | |
|---|---|---|---|---|
| 8,170,247 | B2 * | 5/2012 | Nishizaki | H04R 25/43 381/119 |
| 8,199,945 | B2 * | 6/2012 | Kornagel | H04R 25/407 381/23.1 |
| 9,351,086 | B2 * | 5/2016 | Petersen | H04R 25/50 |
| 9,451,370 | B2 * | 9/2016 | Hasler | H04R 25/43 |
| 9,565,501 | B2 * | 2/2017 | Barthel | H04R 25/50 |
| 10,051,387 | B2 * | 8/2018 | Udesen | H04R 25/554 |
| 2012/0114155 | A1 * | 5/2012 | Nishizaki | H04R 25/43 381/313 |
| 2018/0234775 | A1 * | 8/2018 | Junius | H04R 25/305 |
| 2018/0317024 | A1 * | 11/2018 | Roeck | H04B 1/385 |
| 2019/0116434 | A1 * | 4/2019 | Fretz | H04R 25/554 |

* cited by examiner

HEARING DEVICE COMPRISING A WIRELESS RECEIVER OF SOUND

SUMMARY

The present disclosure relates to hearing devices, e.g. hearing aids, and in particular to parallel reception in the hearing device of an audio signal from an audio source, e.g. a TV, via a wireless link and via an acoustic propagation channel, respectively.

A Hearing Device:

In an aspect of the present application, a hearing device, e.g. a hearing aid, adapted for being located at or in an ear of a user and/or for being fully or partially implanted in the head of the user is provided. The hearing device comprises

- A multitude of input units each providing an electric input signal representing a mixture of an audio signal from an audio signal source and possibly acoustic signals from other acoustic signal sources around the hearing device as received at the input unit in question;
- A wireless receiver for receiving and providing a direct representation of the audio signal;
- A beamformer filtering unit configured to receive said multitude of electric input signals, and providing a beamformed signal;
- A combination unit for providing a mixed signal comprising a combination of said direct representation of the audio signal and said beamformed signal, or signals originating therefrom;
- An output unit for presenting stimuli perceivable to the user as sound based on said mixed signal.

The hearing device is further arranged to provide that the beamformer filtering unit comprises an audio signal cancelling beamformer configured to provide that sound from a direction from the hearing device to the audio signal source is cancelled or attenuated compared to other directions in said beamformed signal. Alternatively, the hearing device (e.g. the beamformer filtering unit) may be arranged to cancel or attenuate said audio signal from said audio signal source (in said beamformed signal) in dependence of said direct representation of the audio signal or on an estimate or an indication (e.g. from a user interface) of a direction to said audio signal source.

The beamformer filtering unit may be arranged to cancel or attenuate the audio signal from the audio signal source in the beamformed signal in dependence of whether or not the direct representation of the audio signal is present or not.

Thereby an improved hearing device is provided.

The term 'signals originating therefrom' is in the present context taken to mean, e.g. processed versions of the signal in question, e.g. having been subject to a noise reduction scheme, a dereverberation algorithm, a compressive amplification algorithm, etc. In its simplest from, the audio signal cancelling beamformer comprises a fixed beamformer configured to provide that sound from the direction from the hearing device to the audio signal source (e.g. the look direction of the user) is cancelled or attenuated compared to other directions in said beamformed signal (such direction being e.g. termed a 'null direction').

In an embodiment, the direction from the hearing device to the audio signal source is defined by a look direction of the user (e.g. by a microphone axis of microphones of the hearing device. In an embodiment, the direction from the hearing device to the audio signal source is defined by the user, e.g. via a user interface (see e.g. FIG. 5B). In an embodiment, the direction from the hearing device to the audio signal is adaptively determined. In an embodiment, the direction from the hearing device to the audio signal is adaptively determined and limited to a specific angle range relative to a look direction of the user, e.g. the front half-plane of the user, e.g. +/−60° around the look direction (0°).

In an embodiment, the combination unit is a weighting unit providing the mixed signal as a weighted combination of said direct representation of the audio signal and said beamformed signal, or signals originating therefrom. In an embodiment, the mixed signal is a (possibly weighted) sum of the direct representation of the audio signal and the beamformed signal.

In an embodiment, the beamformer filtering unit comprises an MVDR beamformer. In an embodiment, the beamformer filtering unit comprises generalized sidelobe cancelling (GSC) beamformer.

In an embodiment, the hearing device comprises a wireless signal detector configured to detect whether or not—at a given point in time—a wireless direct representation of the audio signal is received by the hearing device, and to provide a detector signal indicative thereof.

In an embodiment, the wireless signal detector is configured to detect whether or not a received wireless signal comprises speech or not (or with what probability is comprises speech).

In an embodiment, the hearing device comprises a control unit for receiving said direct representation of the audio signal and determining or defining a direction from the hearing device to the audio signal source. In an embodiment, the control unit comprises the wireless signal detector. In an embodiment, control unit is configured to determine or define a direction from the hearing device to one or more other sound sources of interest to the user (other than the audio sound source). In an embodiment, the control unit is configured to adaptively determine the look direction for one or more other sound sources of interest to the user (other than the audio sound source), e.g. whenever sound of interest is detected as not being part of the television signal.

In an embodiment, the hearing device comprises an adaptive filter configured to determine the spatial filter, e.g. the MVDR beamformer, that minimizes the correlation between the acoustically propagated sound and the wirelessly received sound under the constraint that noise from a direction to another sound source of interest, e.g. to the side of the user, is unaltered. In an embodiment, the beamformer filtering unit comprises an adaptive filter configured to determine a spatial filter (e.g. an MVDR beamformer) that minimizes the correlation between the acoustically propagated sound represented by said electric input signal(s) and the wirelessly received sound represented by said direct representation of the audio signal under the constraint that noise from a direction to another sound source of interest (other than said audio signal source, e.g. to the side of the user) is unaltered. In an embodiment, filter coefficients of the spatial filter are update when the audio signal source is active. A detection of whether or not the audio signal source is active may e.g. be determined using a detector in the wireless receiver (e.g. a wireless signal strength detector) or another detector monitoring the presence or contents of the direct representation of the audio signal.

In an embodiment, the hearing device comprises a controller configured to minimize the correlation between the acoustically propagated sound and the wirelessly received sound only, when the wireless signal is being received by the hearing device. In an embodiment, the hearing device is configured to enter a specific audio signal reception mode, when the detector signal is indicative of a wireless direct representation of the audio signal being received by the hearing device. In an embodiment, the hearing device is configured to leave the specific audio signal reception mode, when the detector signal is indicative of a wireless direct representation of the audio signal being no longer received by the hearing device.

In an embodiment, the hearing device comprises a user interface allowing a user to influence a location of or direction to an acoustic signal source of interest to the user other than the audio signal source. In an embodiment, the user interface is implemented in a remote control device, e.g. as an APP, e.g. in a smartphone.

In an embodiment, the hearing device comprises a movement sensor for tracking a head movement, or is configured to receive data about head movement from another device, and the control unit is configured to update beamformer filtering coefficients in dependence of detected head movements. In an embodiment, a null direction (as well as a look direction) may be updated according to head movements.

In an embodiment, the hearing device comprises a hearing aid, a headset, an earphone, an ear protection device or a combination thereof.

In an embodiment, the hearing device, e.g. a hearing aid, is adapted to provide a frequency dependent gain and/or a level dependent compression and/or a transposition (with or without frequency compression) of one or frequency ranges to one or more other frequency ranges, e.g. to compensate for a hearing impairment of a user. In an embodiment, the hearing device comprises a signal processor for enhancing the input signals and providing a processed output signal.

The hearing device comprises an output unit for providing a stimulus perceived by the user as an acoustic signal based on a processed electric signal. In an embodiment, the output unit comprises a number of electrodes of a cochlear implant type hearing device. In an embodiment, the output unit comprises an output transducer. In an embodiment, the output transducer comprises a receiver (loudspeaker) for providing the stimulus as an acoustic signal to the user. In an embodiment, the output transducer comprises a vibrator for providing the stimulus as mechanical vibration of a skull bone to the user (e.g. in a bone-attached or bone-anchored hearing device).

The hearing device comprises an input unit for providing an electric input signal representing sound. In an embodiment, the input unit comprises an input transducer, e.g. a microphone, for converting an input sound to an electric input signal. In an embodiment, the input unit comprises a wireless receiver for receiving a wireless signal comprising sound and for providing an electric input signal representing said sound.

The hearing device comprises a directional microphone system (e.g. a beamformer filtering unit) adapted to spatially filter sounds from the environment, and thereby attenuate sound from one or more directions in the local environment of the user wearing the hearing device. In an embodiment, the directional system is adapted to detect (such as adaptively detect) from which direction a particular part of the microphone signal originates. This can be achieved in various different ways as e.g. described in the prior art. In hearing devices, a microphone array beamformer is often used for spatially attenuating background noise sources. Many beamformer variants can be found in literature. The minimum variance distortionless response (MVDR) beamformer is widely used in microphone array signal processing. Ideally the MVDR beamformer keeps the signals from the target direction (also referred to as the look direction) unchanged, while attenuating sound signals from other directions maximally. The generalized sidelobe canceller (GSC) structure is an equivalent representation of the MVDR beamformer offering computational and numerical advantages over a direct implementation in its original form.

The hearing device comprises an antenna and transceiver circuitry (e.g. a wireless receiver) for wirelessly receiving a direct electric input signal from another device, e.g. from an entertainment device (e.g. a TV-set), a communication device, a wireless microphone, or another hearing device. In an embodiment, the direct electric input signal represents or comprises an audio signal (e.g. a direct representation of the audio signal) and/or a control signal and/or an information signal. In an embodiment, the hearing device comprises demodulation circuitry for demodulating the received direct electric input to provide the direct electric input signal representing an audio signal and/or a control signal e.g. for setting an operational parameter (e.g. volume) and/or a processing parameter of the hearing device. In general, a wireless link established by antenna and transceiver circuitry of the hearing device can be of any type. In an embodiment, the wireless link is established between two devices, e.g. between an entertainment device (e.g. a TV) and the hearing device, or between two hearing devices, e.g. via a third, intermediate device (e.g. a processing device, such as a remote control device, a smartphone, etc.). In an embodiment, the wireless link is used under power constraints, e.g. in that the hearing device is or comprises a portable (typically battery driven) device. In an embodiment, the wireless link is a link based on near-field communication, e.g. an inductive link based on an inductive coupling between antenna coils of transmitter and receiver parts. In another embodiment, the wireless link is based on far-field, electromagnetic radiation. In an embodiment, the communication via the wireless link is arranged according to a specific modulation scheme, e.g. an analogue modulation scheme, such as FM (frequency modulation) or AM (amplitude modulation) or PM (phase modulation), or a digital modulation scheme, such as ASK (amplitude shift keying), e.g. On-Off keying, FSK (frequency shift keying), PSK (phase shift keying), e.g. MSK (minimum shift keying), or QAM (quadrature amplitude modulation), etc.

In an embodiment, the communication between the hearing device and the other device is in the base band (audio frequency range, e.g. between 0 and 20 kHz). Preferably, communication between the hearing device and the other device is based on some sort of modulation at frequencies above 100 kHz. Preferably, frequencies used to establish a communication link between the hearing device and the other device is below 50 GHz, e.g. located in a range from 50 MHz to 70 GHz, e.g. above 300 MHz, e.g. in an ISM range above 300 MHz, e.g. in the 900 MHz range or in the 2.4 GHz range or in the 5.8 GHz range or in the 60 GHz range (ISM=Industrial, Scientific and Medical, such standardized ranges being e.g. defined by the International Telecommunication Union, ITU). In an embodiment, the wireless link is based on a standardized or proprietary technology. In an embodiment, the wireless link is based on Bluetooth technology (e.g. Bluetooth Low-Energy technology).

In an embodiment, the hearing device is a portable device, e.g. a device comprising a local energy source, e.g. a battery, e.g. a rechargeable battery.

In an embodiment, the hearing device comprises a forward or signal path between an input unit (e.g. an input transducer, such as a microphone or a microphone system and/or direct electric input (e.g. a wireless receiver)) and an output unit, e.g. an output transducer. In an embodiment, the signal processor is located in the forward path. In an embodiment, the signal processor is adapted to provide a frequency dependent gain according to a user's particular needs. In an embodiment, the hearing device comprises an analysis path comprising functional components for analyzing the input signal (e.g. determining a level, a modulation, a type of signal, an acoustic feedback estimate, etc.). In an embodiment, some or all signal processing of the analysis path and/or the signal path is conducted in the frequency domain. In an embodiment, some or all signal processing of the analysis path and/or the signal path is conducted in the time domain.

In an embodiment, an analogue electric signal representing an acoustic signal is converted to a digital audio signal in an analogue-to-digital (AD) conversion process, where the analogue signal is sampled with a predefined sampling frequency or rate $f_s$, $f_s$ being e.g. in the range from 8 kHz to 48 kHz (adapted to the particular needs of the application) to provide digital samples $x_n$ (or x[n]) at discrete points in time $t_n$ (or n), each audio sample representing the value of the acoustic signal at $t_n$ by a predefined number $N_b$ of bits, $N_b$ being e.g. in the range from 1 to 48 bits, e.g. 24 bits. Each audio sample is hence quantized using $N_b$ bits (resulting in $2^{Nb}$ different possible values of the audio sample). A digital sample x has a length in time of $1/f_s$, e.g. 50 μs, for $f_s$=20 kHz. In an embodiment, a number of audio samples are arranged in a time frame. In an embodiment, a time frame comprises 64 or 128 audio data samples. Other frame lengths may be used depending on the practical application.

In an embodiment, the hearing devices comprise an analogue-to-digital (AD) converter to digitize an analogue input (e.g. from an input transducer, such as a microphone) with a predefined sampling rate, e.g. 20 kHz. In an embodiment, the hearing devices comprise a digital-to-analogue (DA) converter to convert a digital signal to an analogue output signal, e.g. for being presented to a user via an output transducer.

In an embodiment, the hearing device, e.g. the microphone unit, and or the transceiver unit comprise(s) a TF-conversion unit for providing a time-frequency representation of an input signal. In an embodiment, the time-frequency representation comprises an array or map of corresponding complex or real values of the signal in question in a particular time and frequency range. In an embodiment, the TF conversion unit comprises a filter bank for filtering a (time varying) input signal and providing a number of (time varying) output signals each comprising a distinct frequency range of the input signal. In an embodiment, the TF conversion unit comprises a Fourier transformation unit for converting a time variant input signal to a (time variant) signal in the (time-)frequency domain. In an embodiment, the frequency range considered by the hearing device from a minimum frequency $f_{min}$ to a maximum frequency $f_{max}$ comprises a part of the typical human audible frequency range from 20 Hz to 20 kHz, e.g. a part of the range from 20 Hz to 12 kHz. Typically, a sample rate $f_s$ is larger than or equal to twice the maximum frequency $f_{mass}$, $f_s \geq 2f_{max}$. In an embodiment, a signal of the forward and/or analysis path of the hearing device is split into a number NI of frequency bands (e.g. of uniform width), where NI is e.g. larger than 5, such as larger than 10, such as larger than 50, such as larger than 100, such as larger than 500, at least some of which are processed individually. In an embodiment, the hearing device is/are adapted to process a signal of the forward and/or analysis path in a number NP of different frequency channels (NP≤NI). The frequency channels may be uniform or non-uniform in width (e.g. increasing in width with frequency), overlapping or non-overlapping.

In an embodiment, the hearing device comprises a number of detectors configured to provide status signals relating to a current physical environment of the hearing device (e.g. the current acoustic environment), and/or to a current state of the user wearing the hearing device, and/or to a current state or mode of operation of the hearing device. Alternatively or additionally, one or more detectors may form part of an external device in communication (e.g. wirelessly) with the hearing device. An external device may e.g. comprise another hearing device, a remote control, and audio delivery device, a telephone (e.g. a Smartphone), an external sensor, etc.

In an embodiment, one or more of the number of detectors operate(s) on the full band signal (time domain). In an embodiment, one or more of the number of detectors operate(s) on band split signals ((time-) frequency domain), e.g. in a limited number of frequency bands.

In an embodiment, the number of detectors comprises a level detector for estimating a current level of a signal of the forward path. In an embodiment, the hearing device is configured to determine whether the current level of a signal of the forward path is above or below a given (L-)threshold value.

In a particular embodiment, the hearing device comprises a voice detector (VD) for estimating whether or not (or with what probability) an input signal comprises a voice signal (at a given point in time). A voice signal is in the present context taken to include a speech signal from a human being. It may also include other forms of utterances generated by the human speech system (e.g. singing). In an embodiment, the voice detector unit is adapted to classify a current acoustic environment of the user as a VOICE or NO-VOICE environment. This has the advantage that time segments of the electric microphone signal comprising human utterances (e.g. speech) in the user's environment can be identified, and thus separated from time segments only (or mainly) comprising other sound sources (e.g. artificially generated noise). In an embodiment, the voice detector is adapted to detect as a VOICE also the user's own voice. Alternatively, the voice detector is adapted to exclude a user's own voice from the detection of a VOICE.

In an embodiment, the hearing device comprises an own voice detector for estimating whether or not (or with what probability) a given input sound (e.g. a voice, e.g. speech) originates from the voice of the user of the system. In an embodiment, a microphone system of the hearing device is adapted to be able to differentiate between a user's own voice and another person's voice and possibly from NON-voice sounds.

In an embodiment, the hearing device comprises a classification unit configured to classify the current situation based on input signals from (at least some of) the detectors, and possibly other inputs as well. In the present context 'a current situation' is taken to be defined by one or more of a) the physical environment (e.g. including the current electromagnetic environment, e.g. the occurrence of electromagnetic signals (e.g. comprising audio and/or control signals) intended or not intended for reception by the hearing device, or other properties of the current environment than acoustic);

b) the current acoustic situation (input level, feedback, etc.), and c) the current mode or state of the user (movement, temperature, cognitive load, etc.);

d) the current mode or state of the hearing device (program selected, time elapsed since last user interaction, etc.) and/or of another device in communication with the hearing device.

In an embodiment, the hearing device comprises an acoustic (and/or mechanical) feedback suppression system. In an embodiment, the hearing device further comprises other relevant functionality for the application in question, e.g. compression, noise reduction, etc.

In an embodiment, the hearing device comprises a listening device, e.g. a hearing aid, e.g. a hearing instrument, e.g. a hearing instrument adapted for being located at the ear or fully or partially in the ear canal of a user, e.g. a headset, an earphone, an ear protection device or a combination thereof.

Use:

In an aspect, use of a hearing device as described above, in the 'detailed description of embodiments' and in the claims, is moreover provided. In an embodiment, use is provided in a system comprising audio distribution. In an embodiment, use is provided in a system comprising one or more hearing aids (hearing instruments), headsets, ear phones, active ear protection systems, etc. In an embodiment, use is provided in connection with a television or a wireless microphone.

A Method:

In an aspect, a method of operating a hearing device, e.g. a hearing aid, adapted for being located at or in an ear of a user and/or for being fully or partially implanted in the head of the user is furthermore provided by the present application. The method comprises

- providing a multitude of electric input signals, each representing a mixture of an audio signal from an audio signal source and possibly other acoustic signals from other signal sources around the hearing device as received at a given input unit of the hearing device;
- wirelessly receiving and providing a direct representation of the audio signal;
- providing a beamformed signal in dependence of said multitude of electric input signals;
- providing a mixed signal comprising a combination of said direct representation of the audio signal and said beamformed signal, or signals originating therefrom;
- presenting stimuli perceivable to the user as sound based on said mixed signal, and
- providing that sound from the direction from the hearing device to the audio signal source is cancelled or attenuated compared to other directions in said beamformed signal.

It is intended that some or all of the structural features of the device described above, in the 'detailed description of embodiments' or in the claims can be combined with embodiments of the method, when appropriately substituted by a corresponding process and vice versa. Embodiments of the method have the same advantages as the corresponding devices.

The method may comprise cancelling or attenuating said audio signal from said audio signal source (in said beamformed signal) in dependence of said direct representation of the audio signal or on an estimate or indication (e.g. from a user) of a direction to said audio signal source.

A Computer Readable Medium:

In an aspect, a tangible computer-readable medium storing a computer program comprising program code means for causing a data processing system to perform at least some (such as a majority or all) of the steps of the method described above, in the 'detailed description of embodiments' and in the claims, when said computer program is executed on the data processing system is furthermore provided by the present application.

By way of example, and not limitation, such computer-readable media can comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. Disk and disc, as used herein, includes compact disc (CD), laser disc, optical disc, digital versatile disc (DVD), floppy disk and Blu-ray disc where disks usually reproduce data magnetically, while discs reproduce data optically with lasers. Combinations of the above should also be included within the scope of computer-readable media. In addition to being stored on a tangible medium, the computer program can also be transmitted via a transmission medium such as a wired or wireless link or a network, e.g. the Internet, and loaded into a data processing system for being executed at a location different from that of the tangible medium.

A Computer Program:

A computer program (product) comprising instructions which, when the program is executed by a computer, cause the computer to carry out (steps of) the method described above, in the 'detailed description of embodiments' and in the claims is furthermore provided by the present application.

A Data Processing System:

In an aspect, a data processing system comprising a processor and program code means for causing the processor to perform at least some (such as a majority or all) of the steps of the method described above, in the 'detailed description of embodiments' and in the claims is furthermore provided by the present application.

A Hearing System:

In a further aspect, a hearing system comprising a hearing device as described above, in the 'detailed description of embodiments', and in the claims, AND an auxiliary device is moreover provided.

In an embodiment, the system is adapted to establish a communication link between the hearing device and the auxiliary device to provide that information (e.g. control and status signals, possibly audio signals) can be exchanged or forwarded from one to the other. An advantage of having more than two microphones, e.g. relying on microphones located at each ear of the user to provide a binaural beamformer, is that sounds from more than one direction can be attenuated. This might e.g. be of interest, if the television sound is presented via multiple loudspeakers (surround sound).

In an embodiment, the auxiliary device is or comprises a smartphone or similar communication device.

In an embodiment, the auxiliary device is or comprises a remote control for controlling functionality and operation of the hearing device(s). In an embodiment, the function of a remote control is implemented in a SmartPhone, the SmartPhone possibly running an APP allowing to control the functionality of the audio processing device via the SmartPhone (the hearing device(s) comprising an appropriate wireless interface to the SmartPhone, e.g. based on Bluetooth or some other standardized or proprietary scheme).

In an embodiment, the auxiliary device is or comprises an audio gateway device adapted for receiving a multitude of audio signals (e.g. from an entertainment device, e.g. a TV or a music player, a telephone apparatus, e.g. a mobile telephone or a computer, e.g. a PC) and adapted for selecting and/or combining an appropriate one of the received audio signals (or combination of signals) for transmission to the hearing device.

In an embodiment, the auxiliary device is or comprises another hearing device. In an embodiment, the hearing system comprises two hearing devices adapted to implement a binaural hearing system, e.g. a binaural hearing aid system. In an embodiment, the hearing system is configured to apply spatial cues to the TV-signal in order to provide a perceived spatial direction of the TV sound to the user, e.g. as proposed in our co-pending European patent application [Farmani et al.; 2017b]. In an embodiment, the hearing system comprises a movement sensor, e.g. a gyroscope, to detect movements of the head, and configured to make the streamed audio signal, e.g. a TV signal, appearing from the same place even though the head is turning by adapting the applied spatial cues (e.g. head related transfer functions or relative transfer functions) taking account of the head rotation.

An APP:

In a further aspect, a non-transitory application, termed an APP, is furthermore provided by the present disclosure. The APP comprises executable instructions configured to be executed on an auxiliary device to implement a user interface for a hearing device or a hearing system described above in the 'detailed description of embodiments', and in the claims. In an embodiment, the APP is configured to run on cellular phone, e.g. a smartphone, or on another portable device allowing communication with said hearing device or said hearing system.

Definitions:

In the present context, a 'hearing device' refers to a device, such as a hearing aid, e.g. a hearing instrument, or an active ear-protection device, or other audio processing device, which is adapted to improve, augment and/or protect the hearing capability of a user by receiving acoustic signals from the user's surroundings, generating corresponding audio signals, possibly modifying the audio signals and providing the possibly modified audio signals as audible signals to at least one of the user's ears. A 'hearing device' further refers to a device such as an earphone or a headset adapted to receive audio signals electronically, possibly modifying the audio signals and providing the possibly modified audio signals as audible signals to at least one of the user's ears. Such audible signals may e.g. be provided in the form of acoustic signals radiated into the user's outer ears, acoustic signals transferred as mechanical vibrations to the user's inner ears through the bone structure of the user's head and/or through parts of the middle ear as well as electric signals transferred directly or indirectly to the cochlear nerve of the user.

The hearing device may be configured to be worn in any known way, e.g. as a unit arranged behind the ear with a tube leading radiated acoustic signals into the ear canal or with an output transducer, e.g. a loudspeaker, arranged close to or in the ear canal, as a unit entirely or partly arranged in the pinna and/or in the ear canal, as a unit, e.g. a vibrator, attached to a fixture implanted into the skull bone, as an attachable, or entirely or partly implanted, unit, etc. The hearing device may comprise a single unit or several units communicating electronically with each other. The loudspeaker may be arranged in a housing together with other components of the hearing device, or may be an external unit in itself (possibly in combination with a flexible guiding element, e.g. a dome-like element).

More generally, a hearing device comprises an input transducer for receiving an acoustic signal from a user's surroundings and providing a corresponding input audio signal and/or a receiver for electronically (i.e. wired or wirelessly) receiving an input audio signal, a (typically configurable) signal processing circuit (e.g. a signal processor, e.g. comprising a configurable (programmable) processor, e.g. a digital signal processor) for processing the input audio signal and an output unit for providing an audible signal to the user in dependence on the processed audio signal. The signal processor may be adapted to process the input signal in the time domain or in a number of frequency bands. In some hearing devices, an amplifier and/or compressor may constitute the signal processing circuit. The signal processing circuit typically comprises one or more (integrated or separate) memory elements for executing programs and/or for storing parameters used (or potentially used) in the processing and/or for storing information relevant for the function of the hearing device and/or for storing information (e.g. processed information, e.g. provided by the signal processing circuit), e.g. for use in connection with an interface to a user and/or an interface to a programming device. In some hearing devices, the output unit may comprise an output transducer, such as e.g. a loudspeaker for providing an air-borne acoustic signal or a vibrator for providing a structure-borne or liquid-borne acoustic signal. In some hearing devices, the output unit may comprise one or more output electrodes for providing electric signals (e.g. a multi-electrode array for electrically stimulating the cochlear nerve).

In some hearing devices, the vibrator may be adapted to provide a structure-borne acoustic signal transcutaneously or percutaneously to the skull bone. In some hearing devices, the vibrator may be implanted in the middle ear and/or in the inner ear. In some hearing devices, the vibrator may be adapted to provide a structure-borne acoustic signal to a middle-ear bone and/or to the cochlea. In some hearing devices, the vibrator may be adapted to provide a liquid-borne acoustic signal to the cochlear liquid, e.g. through the oval window. In some hearing devices, the output electrodes may be implanted in the cochlea or on the inside of the skull bone and may be adapted to provide the electric signals to the hair cells of the cochlea, to one or more hearing nerves, to the auditory brainstem, to the auditory midbrain, to the auditory cortex and/or to other parts of the cerebral cortex.

A hearing device, e.g. a hearing aid, may be adapted to a particular user's needs, e.g. a hearing impairment. A configurable signal processing circuit of the hearing device may be adapted to apply a frequency and level dependent compressive amplification of an input signal. A customized frequency and level dependent gain (amplification or compression) may be determined in a fitting process by a fitting system based on a user's hearing data, e.g. an audiogram, using a fitting rationale (e.g. adapted to speech). The frequency and level dependent gain may e.g. be embodied in processing parameters, e.g. uploaded to the hearing device via an interface to a programming device (fitting system), and used by a processing algorithm executed by the configurable signal processing circuit of the hearing device.

A 'hearing system' refers to a system comprising one or two hearing devices, and a 'binaural hearing system' refers to a system comprising two hearing devices and being adapted to cooperatively provide audible signals to both of the user's ears. Hearing systems or binaural hearing systems may further comprise one or more 'auxiliary devices', which communicate with the hearing device(s) and affect and/or benefit from the function of the hearing device(s). Auxiliary devices may be e.g. remote controls, audio gateway devices, mobile phones (e.g. SmartPhones), or music players. Hearing devices, hearing systems or binaural hearing systems may e.g. be used for compensating for a hearing-impaired person's loss of hearing capability, augmenting or protecting a normal-hearing person's hearing capability and/or conveying electronic audio signals to a person. Hearing devices or hearing systems may e.g. form part of or interact with public-address systems, active ear protection systems, handsfree telephone systems, car audio systems, entertainment (e.g. karaoke) systems, teleconferencing systems, classroom amplification systems, etc.

Embodiments of the disclosure may e.g. be useful in applications such as hearing aids.

BRIEF DESCRIPTION OF DRAWINGS

The aspects of the disclosure may be best understood from the following detailed description taken in conjunction with the accompanying figures. The figures are schematic and simplified for clarity, and they just show details to improve the understanding of the claims, while other details are left out. Throughout, the same reference numerals are used for identical or corresponding parts. The individual features of each aspect may each be combined with any or all features of the other aspects. These and other aspects, features and/or technical effect will be apparent from and elucidated with reference to the illustrations described hereinafter in which:

Further scope of applicability of the present disclosure will become apparent from the detailed description given hereinafter. However, it should be understood that the detailed description and specific examples, while indicating preferred embodiments of the disclosure, are given by way of illustration only. Other embodiments may become apparent to those skilled in the art from the following detailed description.

DETAILED DESCRIPTION OF EMBODIMENTS

The detailed description set forth below in connection with the appended drawings is intended as a description of various configurations. The detailed description includes specific details for the purpose of providing a thorough understanding of various concepts. However, it will be apparent to those skilled in the art that these concepts may be practiced without these specific details. Several aspects of the apparatus and methods are described by various blocks, functional units, modules, components, circuits, steps, processes, algorithms, etc. (collectively referred to as "elements"). Depending upon particular application, design constraints or other reasons, these elements may be implemented using electronic hardware, computer program, or any combination thereof.

The electronic hardware may include microprocessors, microcontrollers, digital signal processors (DSPs), field programmable gate arrays (FPGAs), programmable logic devices (PLDs), gated logic, discrete hardware circuits, and other suitable hardware configured to perform the various functionality described throughout this disclosure. Computer program shall be construed broadly to mean instructions, instruction sets, code, code segments, program code, programs, subprograms, software modules, applications, software applications, software packages, routines, subroutines, objects, executables, threads of execution, procedures, functions, etc., whether referred to as software, firmware, middleware, microcode, hardware description language, or otherwise.

Figure 1A:
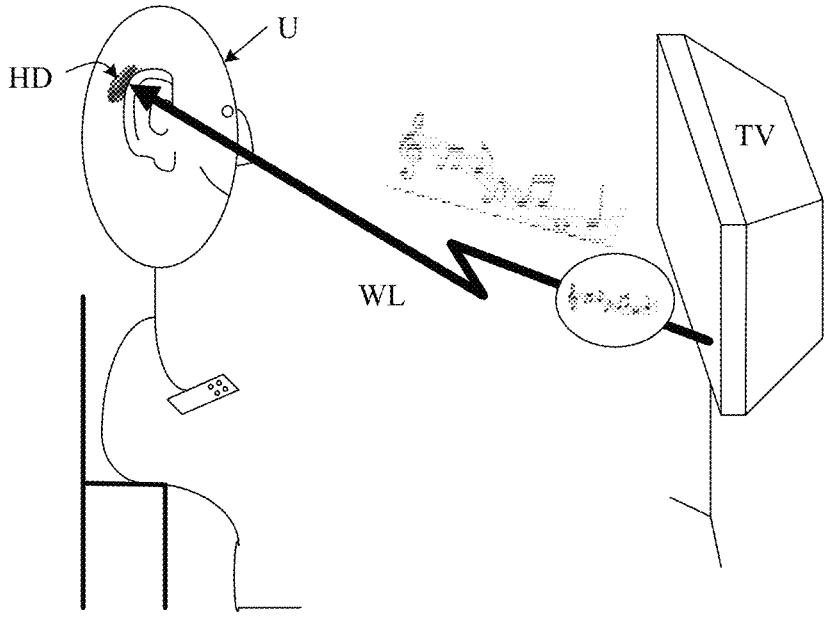
FIG. 1A illustrates the problem when direct and wirelessly transmitted TV sound is received at the hearing aid user.

The present application relates to the field of hearing devices, e.g. hearing aids. Many hearing impaired people watching television tend to turn up the volume to a very high level which other people watching television (or neighbours) find annoyingly loud. As an alternative, it is possible to stream the audio wirelessly to the hearing instrument, hereby letting the hearing aid user adjust the volume locally at the hearing instruments. FIG. 1A illustrates the problem when direct and wirelessly transmitted sound from a TV (TV) is transmitted to a hearing aid user (U) via a wireless link (WL). Hereby the hearing aid user (U) is exposed to both the audio presented via the television's loudspeakers (propagated via an acoustic path) as well as the wirelessly streamed audio signal (termed direct representation of the audio signal). As the signals are not fully time aligned when received in the hearing device (HD), the quality of the resulting sound of the mixture between the acoustically propagated and the wirelessly streamed audio signal is degraded.

A simple solution would be to turn off the hearing aid microphones while the user is watching television, hereby only exposing the hearing aid user to the wirelessly transmitted television signal. This solution has the disadvantage that it prevents the hearing aid user from listening to other sounds of interest.

Another solution would be to adjust delay of the acoustically propagated sound or the delay of the wireless sound in order to align the two signals. The wireless sound may even be subtracted from the acoustically propagated sound in order to remove the television signal from the microphone signal. It is however not easy to estimate the correct delay as the delay changes with the distance between the hearing aids and the television.

Figure 1B:
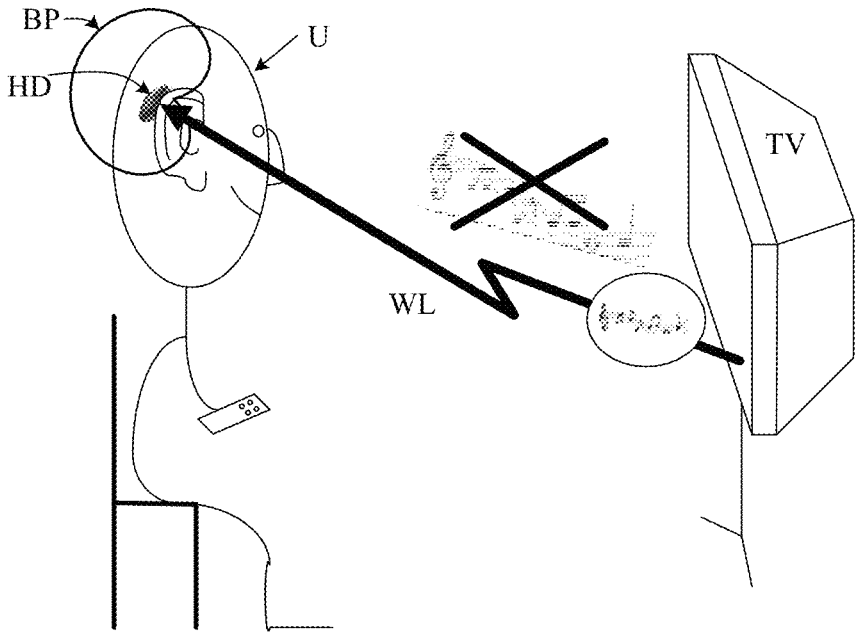
FIG. 1B illustrates a solution where a beamformer is used to cancel the television signal recorded by the hearing aid microphones.

FIG. 1B illustrates a solution to the problem of FIG. 1A. Here, we propose to remove the acoustically propagated television signal (as received by the hearing device (HD)) by spatial filtering, where a beamformer is used to cancel the television signal recorded by the hearing aid microphones (cf. beam pattern BP in FIG. 1B). When more than one microphone is available, an adaptive spatial filter able to cancel the sound in the direction of the television can be created. The adaptive filter takes advantage of the wirelessly streamed television signal. We hereby know the signal we would like to remove in the recorded microphone signals. We may e.g. find the spatial filter that minimizes the correlation between the acoustically propagated sound and the wirelessly transmitted sound under the constraint that noise from e.g. the side is unaltered.

Figure 2:
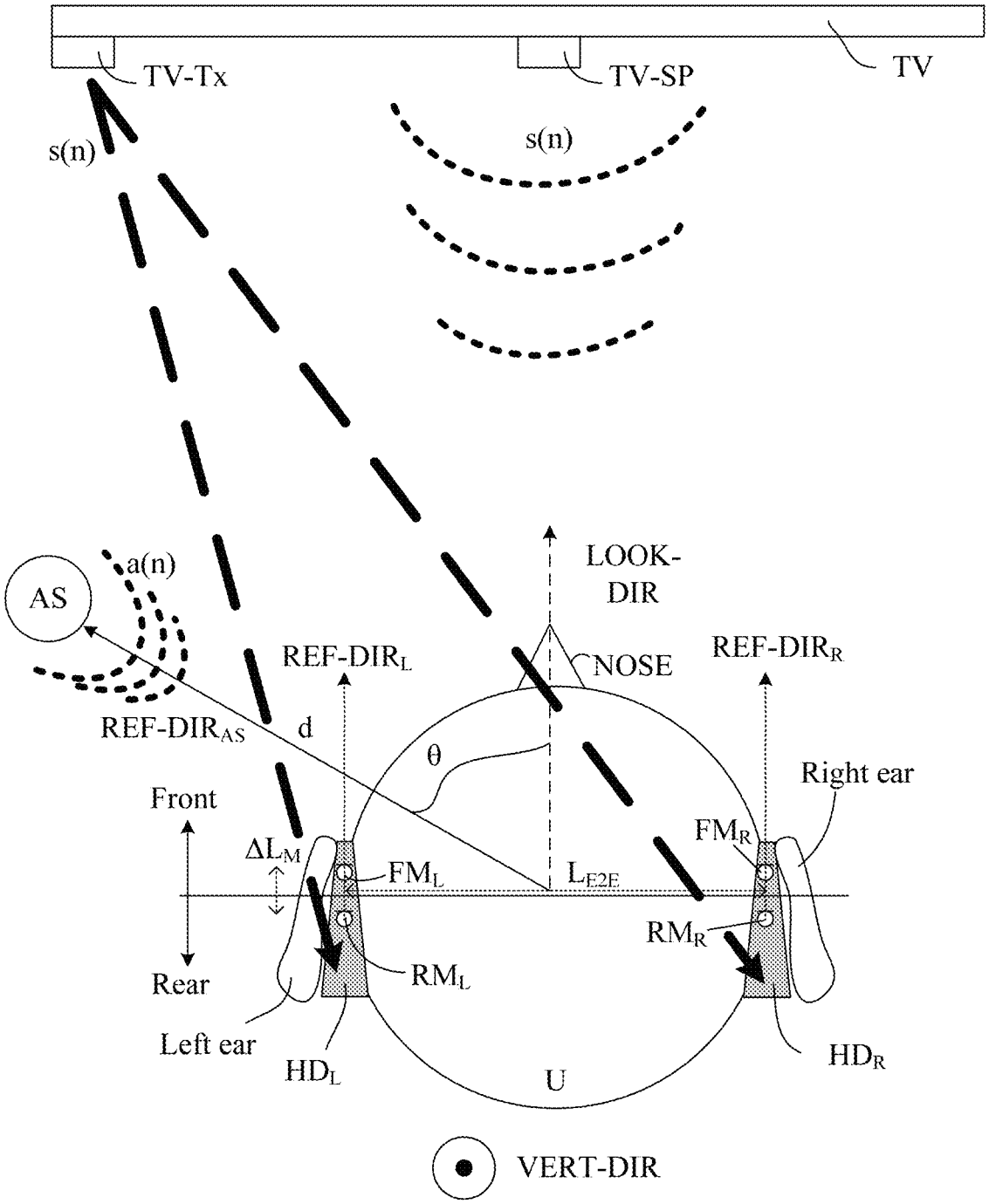
FIG. 2 illustrates a geometrical setup of a specific scenario related to FIG. 1A, 1B, where the user wears a hearing system comprising left and right hearing devices for wireless and acoustic reception of a television signal, in addition to reception of sound signal from a nearby sound source from the environment, other than the TV-sound.

FIG. 2 illustrates the same situation as shown in 1A, 1B, but where a specific (localized) sound source (AS), in addition to the sound from the television set (TV), is present in the environment of the user (U) of a (possibly binaural) hearing system according to the present disclosure. The sound source (S), e.g. a person speaking, is located at a distance d from the user and has a direction-of-arrival (DoA. REF-DIR$_{AS}$) defined (in a horizontal plane) by angle θ relative to a reference direction, here a look direction (LOOK-DIR) of the user. In an embodiment, the direction-of-arrival is around θ=+90° (or θ=−90°, i.e. essentially to the side(s) of the user. In an embodiment, the look direction is adaptively estimated, whenever sound of interest is detected as not being part of the television signal. The sound source (AS) provides acoustic sound a(n), n being a time index, (as indicated in FIG. 2 by three dashed arcs denoted a(n)). The television set (TV) is located in front of the user (U) in a look direction (LOOK-DIR) of the user, and the TV-sound, s(n), produced by a loudspeaker (TV-SP) forming part of or connected to the TV set, is shown to arrive at the user from this direction (indicated by three dashed arcs denoted s(n)). Simultaneously a transmitter (TV-Tx) transmits the (clean) TV-sound, s(n), wirelessly to the left and right hearing devices (HD$_L$, HD$_R$) of the hearing system, as indicated by dashed arrows from TV-transmitter (TV-Tx) to the left and right hearing devices (HD$_L$, HD$_R$).

FIG. 2 schematically illustrates a geometrical arrangement of two sound sources (AS, TV-SP) relative to a hearing system comprising left and right hearing devices (HD$_L$, HD$_R$) when located on the head at or in left (Left ear) and right (Right ear) ears, respectively, of a user (U). Front and rear directions and front and rear half planes of space (cf. arrows Front and Rear) are defined relative to the user (U) and determined by the look direction (LOOK-DIR, dashed arrow) of the user (here defined by the user's nose (NOSE)) and a (vertical) reference plane through the user's ears (solid line perpendicular to the look direction (LOOK-DIR)). The left and right hearing devices (HD$_L$, HD$_R$) each comprise a BTE-part located at or behind-the-ear of the user. In the example of FIG. 2, each BTE-part comprises two microphones, a front located microphone (FM$_L$, FM$_R$) and a rear located microphone (RM$_L$, RM$_R$) of the left and right hearing devices, respectively. The front and rear microphones on each BTE-part are spaced a distance ΔL$_M$ apart along a line (substantially) parallel to the look direction (LOOK-DIR), see dotted lines REF-DIR$_L$ and REF-DIR$_R$, respectively. The two sets of microphones (FM$_L$, RM$_L$), (FM$_R$, RM$_R$) are spaced a distance L$_{E2E}$ apart (e.g. defined by the head of the user, ear-to-ear). The left and right hearing devices (HD$_L$, HD$_R$) each comprises appropriate antenna and transceiver circuitry for wirelessly receiving the TV-sound signal s(n).

Figure 3A:
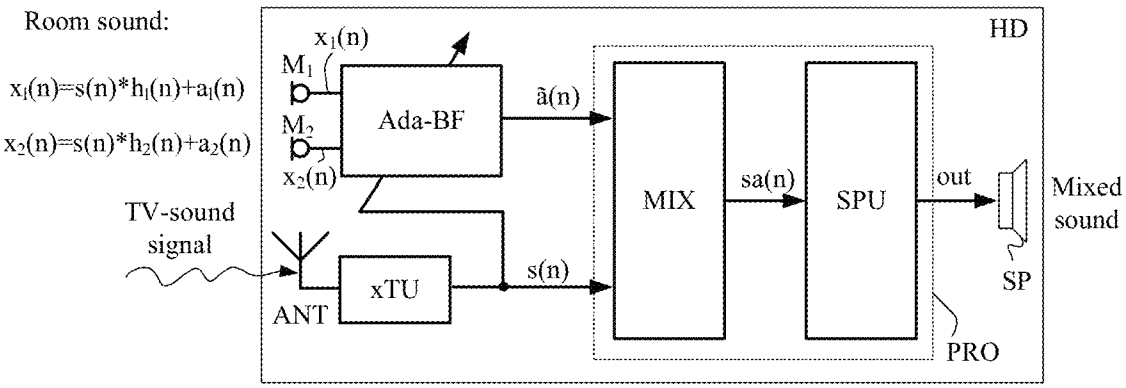
FIG. 3A illustrates a hearing device according to a first embodiment of the present disclosure comprising and adaptive filtering unit and a mixing unit for mixing a wirelessly received TV-sound signal with signals from one or more sound sources in the environment (other than the TV-sound)

FIG. 3A illustrates a hearing device (HD) according to a first embodiment of the present disclosure. The hearing device is adapted for wirelessly receiving an audio signal s(n) from an audio source (TV) in the vicinity of the user (U) wearing the hearing device (HD), e.g. from a TV-set as illustrated in FIGS. 1A, 1B and 2. The hearing device (HD), e.g. a hearing aid, is adapted for being located at or in an ear of a user and/or for being fully or partially implanted in the head of the user. The hearing device comprises a fixed or adaptive filtering unit (Ada-BF) and a mixing unit (MIX) for mixing a wirelessly received TV-sound signal s(n) with signals from one or more sound sources in the environment (other than the TV-sound). The hearing device (HD) comprises a multitude of input units (here microphones M$_1$, M$_2$), each providing an electric input signal x$_1$(n), x$_2$(n), representing a mixture of an audio signal from an audio signal source and possibly acoustic signals from other acoustic signal sources around the hearing device as received at the input unit in question. The mixture of sound (denoted Room sound in FIG. 3A) may be represented by the following expressions at the 1$^{st}$ and 2$^{nd}$ microphones (M$_1$, M$_2$), respectively:

$$x_l(n)=s(n)*h_l(n)+a_l(n)$$

$$x_2(n)=s(n)*h_2(n)+a_2(n)$$

where s(n) is the acoustic signal emitted at TV;

h$_l$(n) is the impulse response from the TV loudspeaker (TV-SP in FIG. 2) to the l'th microphone, here l=1, 2.

a$_l$(n) represents other signals reaching the l'th microphone, e.g., a person talking to the user.

x$_l$(n) is the total acoustically propagated signal received at l'th microphone ã(n) is an estimate of the microphone signal with components originating from the original signal s(n) removed. Ideally, ã(n)=a(n).

The hearing device (HD) further comprises a wireless receiver comprising appropriate antenna and transceiver circuitry (ANT, xTU) for receiving a wirelessly transmitted TV-signal (denoted TV-sound signal in FIG. 3A), and providing a direct representation s(n) of the audio signal from the TV.

The (e.g. adaptive) beamformer filtering unit (Ada-BF) receives the multitude of electric input signals $x_1(n)$, $x_2(n)$, comprising the total acoustically propagated signal as received at $1^{st}$ and $2^{nd}$ microphones, and the wirelessly received TV-sound signal s(n), and is configured to provide a beamformed signal ã(n) representing an estimate of the acoustic signal at the hearing device with components originating from the original signal s(n) removed.

In its simplest from, the beamformer filtering unit (Ada-BF) comprises a fixed beamformer configured to provide that sound from the direction from the hearing device to the audio signal source (e.g. the look direction of the user) is cancelled or attenuated compared to other directions in said beamformed signal. This is illustrated in FIG. 3A by ignoring the dotted arrow from wirelessly received audio signal s(n) to the beamformer filtering unit (Ada-BF).

In an embodiment, the beamformer filtering unit (Ada-BF) comprises an adaptive beamformer. The adaptive beamformer filtering unit (Ada-BF) is configured to determine the spatial filter (beamformer filtering coefficients) that minimizes the correlation between the acoustically received sound and the wirelessly received sound under the constraint that noise from a direction of a sound source of interest (e.g. AS in FIG. 2) in the environment, e.g. from the side, is unaltered. This is illustrated in FIG. 3A by the dotted arrow from wirelessly received audio signal s(n) to the (adaptive) beamformer filtering unit (Ada-BF).

The combination unit, implemented as mixing unit (MIX), for providing a mixed signal sa(n) comprising a combination (e.g. a weighted combination) of the wirelessly received (direct representation of the) audio signal s(n) and the beamformed signal ã(n) (devoid of the TV-signal), or signals originating therefrom.

The hearing device (HD) further comprises a processor (SPU) for processing the mixed signal sa(n) and providing a processed signal out out.

In the embodiment of FIG. 3A, the combination unit (MIX) and the processor (SPU) form part of a signal processor (PRO).

The hearing device (HD) further comprises an output unit (here loudspeaker SP) for presenting stimuli perceivable to the user as sound based on the processed signal out (here as sound, denoted Mixed sound in FIG. 3A).

Figure 3B:
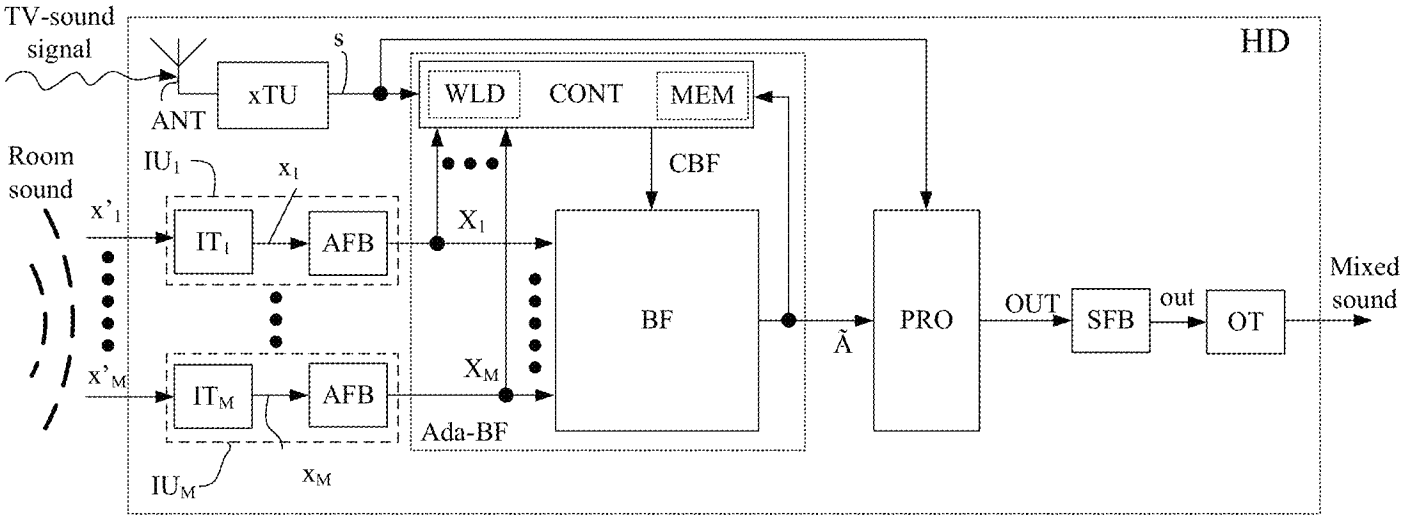
FIG. 3B shows a hearing device according to a second embodiment of the present disclosure comprising a multitude of electric input signals and wherein the adaptive filtering unit comprises a control unit for receiving and/or estimating location of and/or direction to relevant sound sources in the environment.

FIG. 3B shows a hearing device (HD) according to a second embodiment of the present disclosure. The hearing device (HD) of FIG. 3B comprises the same functional elements as described in connection with FIG. 3A. The hearing device (HD) of FIG. 3B comprises a multitude of input units ($IU_l$, l=1, . . . , M) for converting a multitude of sound signals ($x'_l$, l=1, . . . , M) from the environment to a multitude of electric input signals ($X_l$, l=1, . . . , M) in a time-frequency representation (k, m, where k and m are frequency and time-frame indices, respectively). Each of the input units ($IU_l$, l=1, . . . , M) comprises an input transducer ($IT_l$, e.g. a microphone) for converting a sound signal ($x'_l$) to a digitized time domain signal ($x_l$) and an analysis filter bank (AFB) for converting respective time-domain signals ($x'_l$, l=1, . . . , M) to frequency sub-band signals ($X_l$, l=1, . . . , M). An advantage of having more than two microphones (or perhaps a binaural beamformer relying on microphones located at each ear of the user) is that sounds from more than one direction can be attenuated. This might e.g. be the case if the television sound is presented via multiple loudspeakers (surround sound).

The adaptive filtering unit (Ada-BF) may e.g. comprise a minimum variance distortionless response (MVDR) beamformer, e.g. implemented as a generalized sidelobe canceller (GSC) structure.

The adaptive filtering unit (Ada-BF) comprises a control unit (CONT) for receiving and/or estimating a location of and/or direction to relevant sound sources in the environment. The (Ada-BF) receives the wirelessly streamed version s of the audio signal (e.g. a TV-signal). The adaptive filtering unit (Ada-BF) further comprises beamformer filtering unit (BF) receiving the frequency sub-band signals ($X_l$, l=1, . . . , M), and beamformer control signal CBF and providing frequency sub-band signal Ã, comprising an estimate of the environment sound (Room sound) exclusive of the sound (TV-sound) from the audio sound source (TV). The beamformer control signal CBF from the control unit (CONT) may comprise information about direction(s) to the sound source(s) of interest (AS in FIG. 2) in the environment (other than the audio sound source (TV in FIG. 2). Other information that may be advantageously provided by or from the control unit relate to the presence of speech in the signal received from the audio sound source (TV). Such information may be used to update noise information (e.g. represented by an inter-microphone noise correlation matrix $C_a$, including 'noise' from the sound source(s) of interest (AS)) when the no speech is present in the signal received from the audio sound source (TV). The control unit (CONT) comprises a voice activity detector (WLD) for detecting time segments of the wirelessly streamed version s of the audio signal estimated to comprise speech and no speech, respectively (e.g. with a certain probability). This is relatively simple, since a clean version s of the audio signal is available (assuming that the audio signal is of sufficient quality). The control unit (CONT) comprises a memory MEM, e.g. for storing initial (e.g. predefined) values of a location of, or a direction to, one or more sound sources (AS) of interest to the user. In an embodiment, look vector(s) $d_a$ comprising transfer functions (or relative transfer functions, or impulse responses) for sound from the location of the one or more sound sources (AS) of interest to each of the user to the input units $IU_l$, l=1, . . . , M) of the hearing device (HD) are stored in the memory. In an embodiment, beamformer filtering weights, e.g. $w_{mvdr}(k, m)$, at a given point in time are determined from the 'noise' information ($C_a$) and the location information ($d_a$). In an embodiment, the beamformer control signal CBF may comprise such current beamformer filtering weights determined by the control unit (CONT). In such embodiment, the beamformer filtering unit (BF) is configured to apply the beamformer filtering weights to the frequency sub-band signals ($X_l$, l=1, . . . , M). In an embodiment, the hearing device (or an auxiliary device in communication with the hearing device) comprises a movement sensor (such as a gyroscope, an accelerometer or a magnetometer). Hereby the null direction (as well as the look direction) may be updated according to head movements.

The hearing device further comprises a signal processor (PRO) for providing a processed frequency sub-band signal OUT based on the wirelessly received audio signal s and the environment signal Ã. The signal processor (PRO) may e.g. be configured to execute a number of processing algorithms (e.g. for applying a frequency and level dependent gain (or attenuation) to the input signal(s), e.g. to compensate for a hearing impairment of the user, and/or to compensate for a noisy environment) for enhancing the input signals s, Ã. The signal processor (PRO) may comprise other functions, e.g. one or more of noise reduction, feedback cancellation, compressive amplification, etc. The signal processor may e.g. be configured to apply one or more or all of the processing algorithms to the beamformed signal before and/or after the mixing with the wirelessly received direct audio signal s. In an embodiment, the signal processor (PRO) is configured to combine the input signals, s, Ã, before other processing algorithms are applied to the combined signal.

The hearing device further comprises an output unit (OU) for converting the frequency sub-band signal OUT to stimuli perceivable by a user as sound representing the wirelessly received audio sound signal and acoustic signals from the environment (Mixed sound in FIG. 2). The output unit (OU) comprises synthesis filter bank (SFB) for converting the frequency sub-band signal OUT to a time domain signal out, and an output transducer (OT, e.g. a loudspeaker or a vibrator of a bone-conducting hearing device) for converting the time domain signal out to the stimuli perceivable by a user as sound.

Figure 3C:
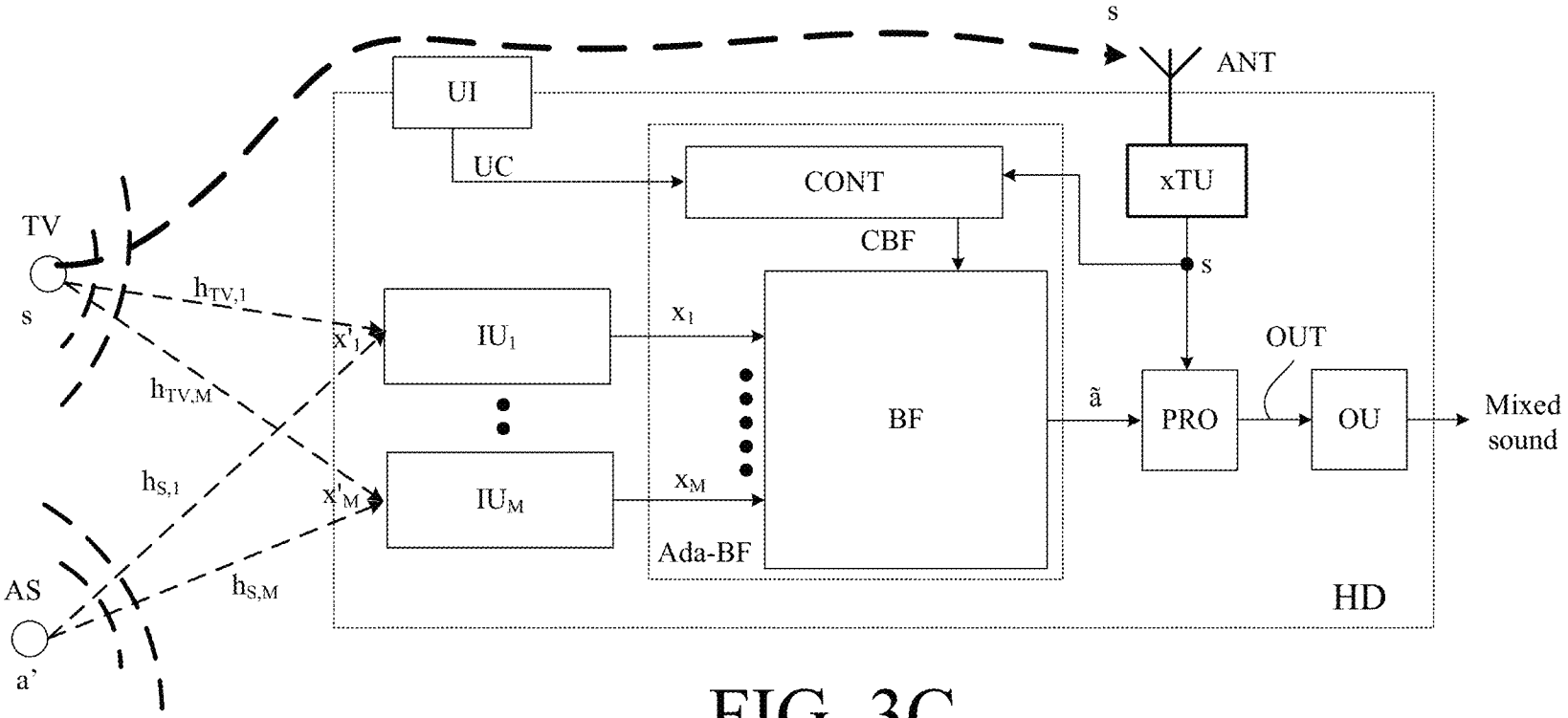
FIG. 3C shows a hearing device according to a third embodiment of the present disclosure, the hearing device comprising an adaptive beamformer filtering unit and a user interface allowing a user to indicate a direction of arrival of sound from the TV and/or from other sound source(s) of interest in the environment.

FIG. 3C shows a hearing device (HD) according to a third embodiment of the present disclosure. The hearing device comprises the same functional units as described in connection with FIGS. 3A, and 3B, but a specific frequency sub-band representation of signals is not illustrated in FIG. 3C; signal processing may be performed in the time domain or in the time-frequency domain or mixed depending on the function to be performed. Compared to the embodiment of FIG. 3B, the hearing device (HD) of FIG. 3C comprises a user interface (UI) allowing a user to influence the adaptive beamformer filtering unit (Ada-BF). In an embodiment, the hearing device is configured to allow the user to indicate a location or direction of arrival (DoA) of sound from the audio sound source (TV) and/or from other sound source(s) (AS) of interest in the environment via the user interface, cf. user control signal UC (cf. e.g. also FIG. 5A, 5B). In FIG. 3C, the acoustic paths from the two sound sources TV and AS to each or the M input units $IU_l$, l=1, . . . , M (M≥2) are indicated. Sound signals $x'_1$, l=1, . . . , M at the respective input units $IU_l$ are generated as a sum of signals from audio sound source (TV) and environment sound source (AS) (the latter here assumed to be dominating), as provided by acoustic propagation of sound source signals s and a', respectively, subject to corresponding impulse responses $h_{TVl}$ and $h_{AS,l}$, l=1, . . . , M.

Figure 4A:
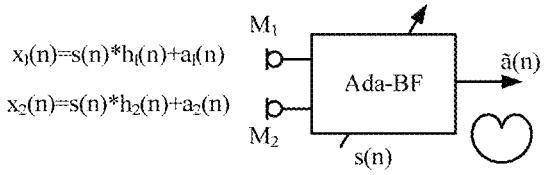
FIG. 4A shows a top level block diagram of an adaptive filtering scheme for removing the direct (acoustically propagated) TV sound from an audio signal to be presented to the user via a hearing device comprising a microphone array.

FIG. 4A shows a top level block diagram of an adaptive filtering scheme (embodied in fixed or adaptive beamformer filtering unit Ada-BF) for removing the direct (acoustically propagated) TV sound from an audio signal to be presented the user via a hearing device comprising a microphone array (here comprising two microphones $M_1$, $M_2$). The fixed version of the beamformer filtering unit (Ada-BF) is configured to provide that sound from the direction from the hearing device to the audio signal source (e.g. the look direction of the user) is cancelled or attenuated compared to other directions in said beamformed signal. The adaptive beamformer filtering unit (Ada-BF) is configured to determine the spatial filter (beamformer filtering coefficients) that minimizes the correlation between the acoustically received sound ($x_1(n)$, $x_2(n)$) and the wirelessly received sound (s(n)) under the constraint that noise from a direction of a sound source of interest (e.g. AS in FIG. 2) in the environment, e.g. from the side, is unaltered. The basic function of the adaptive beamformer filtering unit (Ada-BF) shown in FIG. 4A in a hearing device (HD) according to the present disclosure is described in connection with FIG. 3A.

Many beamformer variants can be found in the literature, see, e.g., [Brandstein & Ward; 2001] and the references therein. The minimum variance distortionless response (MVDR) beamformer is widely used in microphone array signal processing. Ideally the MVDR beamformer keeps the signals from the target direction (also referred to as the look direction) unchanged, while attenuating sound signals from other directions maximally. The generalized sidelobe canceller (GSC) structure is an equivalent representation of the MVDR beamformer offering computational and numerical advantages over a direct implementation in its original form.

Figure 4B:
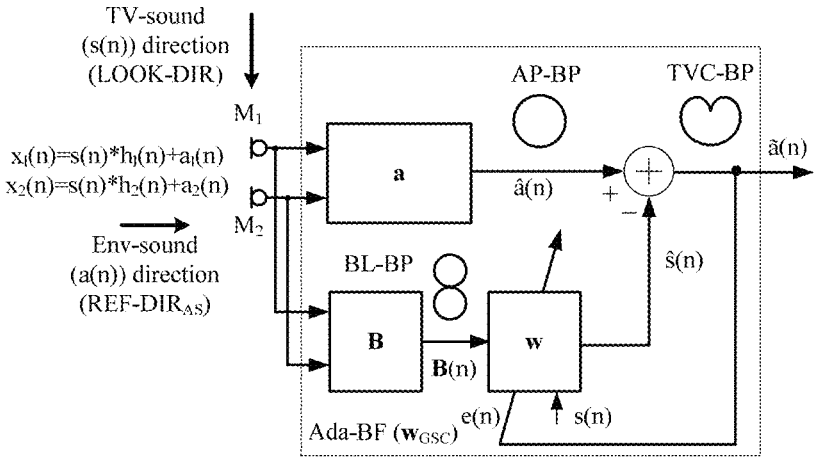
FIG. 4B shows a first embodiment of the adaptive filtering scheme, where a GSC-type beamformer is used to cancel the television signal recorded by the hearing aid microphones, while attending to a nearby sound source from the environment, other than the TV-sound.
Figure 4C:
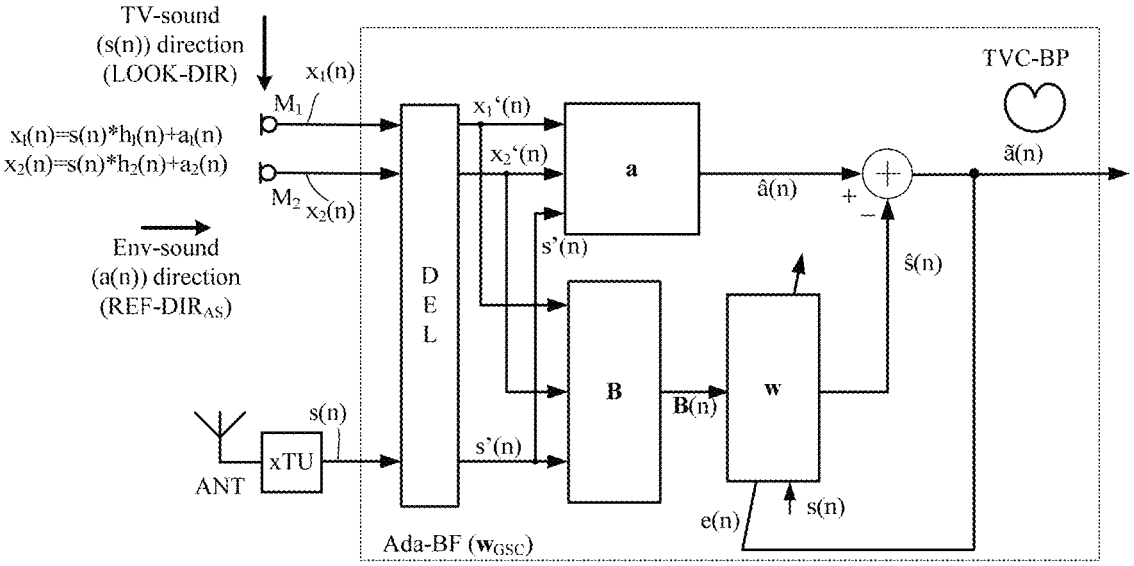
FIG. 4C shows a second embodiment of the adaptive filtering scheme, based on a GSC-type beamformer, as in FIG. 4B, wherein further the wirelessly received signal is used in the estimation of the environment sound (exclusive of the TV-sound)

FIGS. 4B and 4C illustrate first and second embodiments of the adaptive filtering scheme, where a GSC-type beamformer is used to cancel the television signal recorded by the hearing aid microphones, while attending to a nearby sound source from the environment (other than the TV-sound). In the embodiment of FIG. 4C, the wirelessly received signal s(n) is used in the estimation of the environment sound ã(n) (exclusive of the TV-sound).

FIGS. 4B and 4C illustrate possible adaptive filtering schemes, where the spatial filter (Ada-BF) adapts towards cancelling the received wireless sound s from the microphone signals $x_1$, $x_2$. The adaptive spatial filter (Ada-BF ($w_{GSC}$)) may e.g. be or comprise an MVDR beamformer. Assuming that the television signal mainly is in front of the listener (cf. Front in FIG. 2), the look direction (cf. LOOK-DIR in FIG. 2) corresponding to a direction from which the beamformed signal is undistorted can be in any other appropriate direction, e.g. towards the side of the listener (cf. bold arrow denoted Env. Sound (a(n)) direction (REF-$DIR_{AS}$) in FIG. 4B, 4C), or behind the listener, etc. The direction from the TV to the hearing device is indicated by a bold arrow in the direction of the microphone axis of $M_1$ and $M_2$ and denoted TV-sound (s(n)) direction (LOOK-DIR) in FIGS. 4B and 4C) The wireless signal s may also be used for a voice activity detector such that the adaptive spatial filter w only is allowed to adapt, when the wireless signal is active (e.g. comprising speech), cf. input s(n) to the adaptive beamformer w. Further, the look vector $d_{AS}$ representing transfer functions from an environment sound source (AS, other than the TV) to each of the microphones ($M_1$, $M_2$) may be updated in energetic time-frequency frames, where the TV sound s(n) is not active.

The following notation is used in FIG. 4A, 4B, 4C:

- s(n): acoustic signal emitted at TV.
- $h_l(n)$: impulse response from TV loudspeaker to l'th microphone.
- $a_l(n)$: other signals reaching the l'th microphone, e.g., a person talking to the user.
- $x_l(n)$: total signal received at l'th microphone
- ã(n): estimate of the microphone signal with components originating from the original signal s(n) removed. Ideally, ã(n)=a(n).
- e(n): error signal, e(n)=â(n)−ŝ(n), whose energy the beamformer weights are adjusted to minimize.

The adaptive beamformer filtering unit (Ada-BF ($w_{GSC}$)) of FIG. 4B is an embodiment of FIG. 4A. The beamformer filtering unit of FIGS. 4B (and 4C) comprises functional units a, B and w and +. The unit a represents an all pass beamformer unit configured to provide an omni-diectional beam pattern (AP-BP). The output signal â(n) is typically represented by a delay-sum beamformer.

The unit B comprises a blocking filter, e.g. configured to attenuate signals from the side(s) of the user (+/−90°, perpendicular to the look direction (LOOK-DIR) towards the audio source, here the TV). In an embodiment, the look direction is adaptively determined. The output signal b(n) represents a target cancelling beamformer. Preferably, a and B are orthogonal.

The unit w comprises a scaling unit configured to minimize the mean square error of the output signal $\tilde{a}(n)$ (=e(n)).

The combination unit (here adder, +) subtracts the estimate $\hat{s}(n)$ of the acoustic part of the TV-signal from the estimate $\hat{a}(n)$ of the environment sound source of interest (other than the TV), and provides resulting signal $\tilde{a}(n)$ representing an estimation of the environment sound (exclusive of the TV-sound), cf. beam pattern TVC-BP.

The adaptive beamformer filtering unit (Ada-BF ($w_{GSC}$)) of FIG. 4C is similar to the embodiment of FIG. 4B. A difference is, however, that in the embodiment in FIG. 4C beamformer weights ($w_1$, $w_2$) are adaptively adjusted using the wirelessly received TV-signal s(n), to remove any signal component related to s(n) from the microphone signals $x_l(n)$, where l is a microphone index, l=1, . . . , M, where M is the number of microphones of the hearing device or hearing system. In addition to microphone units $M_1$, $M_2$, providing microphone signals $x_1$, $x_2$, the embodiment of FIG. 4C further comprises a wireless receiver comprising appropriate antenna and transceiver circuitry (ANT, xTU) for receiving a wirelessly transmitted TV-signal (denoted TV-sound signal in FIG. 3A), and providing the direct representation s(n) of the audio signal from the TV.

In the embodiment of FIG. 4C, all three input signals $x_1$, $x_2$, s (or delay compensated versions, $x_1'$, $x_2'$, s', thereof) are input to both beamformer blocks a and B. The wireless signal s is delay compensated in order to ensure that the wireless signal and the microphone signals are correlated, cf. unit DEL (representing a delay of an appropriate number of time frames, inserted in the microphone paths and/or the wireless reception path, respectively, and providing delay compensated signals $x_1'$, $x_2'$, and s', respectively. The delay unit may e.g. represent estimated delays (hereby taking transmission delay as well as acoustic propagation delay into account). In the example of FIG. 4C, B is a blocking matrix of size 3×2, and a is a 3×1 matrix.

The adaptive beamformer filtering unit (Ada-BF ($w_{GSC}$)) of FIGS. 4B and 4C can be represented by the expression $$w_{GSC}=a-Bw$$

wherein the adaptive beamformer w can be expressed as:

$$w=(B^H R_{vv} B)^{-1} B^H R_{vv} a,$$

where $R_{vv}$ is the inter-microphone noise covariance matrix, cf. equation (2.44) on page 35 of [Brandstein & Ward; 2001].

The estimate of the environment sound signal $\tilde{a}(n)$ (exclusive of the TV-sound) may then be determined as $$\tilde{a}=w^H_{GSC}x$$

where x is ($x_1$, $x_2$,) or delay compensated versions thereof ($x_1'$, $x_2'$) in FIG. 4B and where x is ($x_1$, $x_2$, s) or delay compensated versions thereof ($x_1'$, $x_2'$, s') in FIG. 4C.

With reference to FIG. 4C, in an embodiment, a is represented by a matrix (vector) $[d_{AS,1}d^*_{AS,1}, d^*_{AS,1}d_{AS,2}, 0]^T$, where T represents transposition. In an embodiment, one column of B is represented by $[(1-d_{AS,1}d^*_{AS,1}), -d^*_{AS,1}d_{AS,2}, 0]$, and the other column of B is represented by $[0,0,1]^T$. Hereby it is fulfilled that $a^H B=[0\ 0]$, where H denotes Hermetian transposition, because $d_{AS,l}\ d^*_{AS,l}=|d_{AS,l}|^2$, l=1, 2, and it is assumed that $|d_{AS,1}|^2+|d_{AS,2}|^2=1$.

Figure 5A:
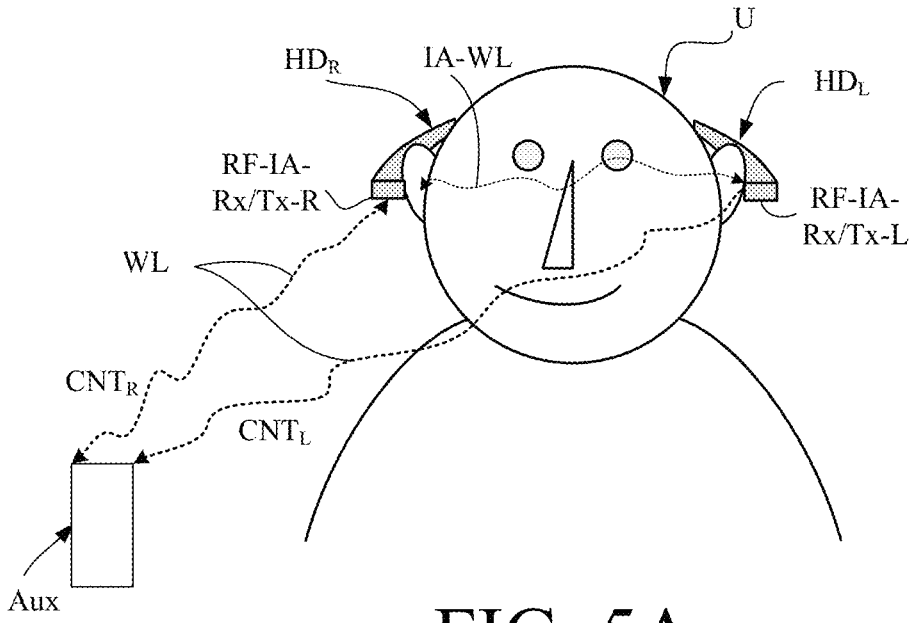
FIG. 5A illustrates an embodiment of a hearing aid system according to the present disclosure comprising left and right hearing devices in communication with an auxiliary device.

FIG. 5A illustrates an embodiment of a hearing system according to the present disclosure. The hearing system comprises left and right hearing devices in communication with an auxiliary device, e.g. a remote control device, e.g. a communication device, such as a cellular telephone or similar device capable of establishing a communication link to one or both of the left and right hearing devices.

Figure 5B:
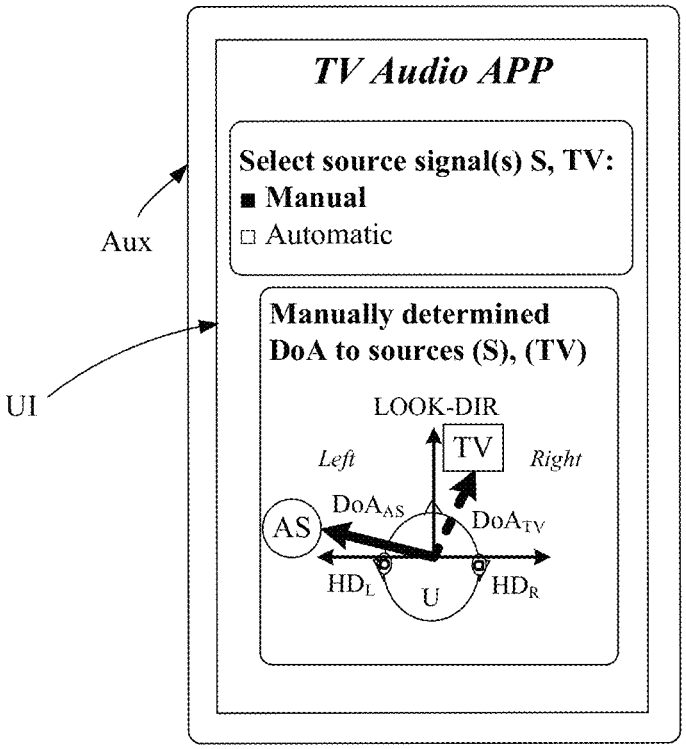
FIG. 5B shows the auxiliary device of FIG. 5A comprising a user interface of the hearing aid system, e.g. implementing a remote control for controlling functionality of the hearing aid system.

FIG. 5A, 5B shows an application scenario comprising an embodiment of a binaural hearing system comprising first and second hearing devices ($HD_R$, $HD_L$), e.g. hearing aids, and an auxiliary device (Aux) according to the present disclosure. The auxiliary device (Aux) comprises a cellular telephone, e.g. a SmartPhone. In the embodiment of FIG. 5A, the hearing devices and the auxiliary device are configured to establish wireless links (WL) between them, e.g. in the form of digital transmission links according to the Bluetooth standard (e.g. Bluetooth Low Energy). The links may alternatively be implemented in any other convenient wireless and/or wired manner, and according to any appropriate modulation type or transmission standard, possibly different for different audio sources. The auxiliary device (e.g. a SmartPhone) of FIG. 5A, 5B comprises a user interface (UI) providing the function of a remote control of the hearing system, e.g. for changing program or operating parameters (e.g. volume) in the hearing device(s), etc. The user interface (UI) of FIG. 5B illustrates an APP (denoted 'TV Audio APP') for selecting a mode of operation of the hearing system where audio signals streamed to the left and right hearing devices ($HD_L$, $HD_R$) are mixed with signals from the environment. The APP allows a user to select a manual (Manual), and an automatic (Automatic) mode (cf. Select source signals AS, TV). In the screen of FIG. 5B, the manual mode of operation has been selected as indicated by the left solid 'tick-box' and the bold face indication Manual. In this mode, the direction of arrival of a target sound source among the acoustic around sources (AS, other than the audio source, e.g. from the TV) and the direction to the audio sound source (TV) can be manually selected, e.g. via the touch sensitive screen. The result is displayed in the screen by circular and square symbols denoted AS and TV, respectively, and bold solid and dashed arrows denoted $DoA_{AS}$ and $DoA_{TV}$, respectively, schematically shown relative to the head of the user to reflect their approximate location. This is indicated by the text Manually determined DoA to sources (AS), (TV) in the lower part of the screen in FIG. 5B. In the manual mode (Manual), an estimate of the location of the target sound source(s) (sound sources of interest to the user) may be indicated by the user via the user interface (UI), e.g. by moving a sound source symbol (circular symbol denoted AS, and rectangular symbol denoted TV in FIG. 5B) to an estimated location on the screen relative to the user's head. In an embodiment, e.g. in the absence of a user input, default directions to the sound sources AS and TV are assumed by the hearing device or hearing system (e.g. as stored in a memory (MEM) of the hearing device (or hearing system)).

In an embodiment (automatic mode), the calculations of the direction of arrival are performed in the auxiliary device, e.g. according to a predefined algorithm, such as e.g. described in [Farmani et al.; 2017a].

In an embodiment, the hearing system is configured to apply appropriate transfer functions to the wirelessly received (streamed) audio signal (from the TV) to reflect its direction of arrival. This has the advantage of providing a sensation of the spatial origin of the streamed signal to the user.

The hearing device ($HD_L$, $HD_R$) are shown in FIG. 5A as devices mounted at the ear (behind the ear) of a user (U). Other styles may be used, e.g. located completely in the ear (e.g. in the ear canal), fully or partly implanted in the head, etc. Each of the hearing instruments comprise a wireless transceiver to establish an interaural wireless link (IA-WL) between the hearing devices, here e.g. based on inductive communication. Each of the hearing devices further comprises a transceiver for establishing a wireless link (WL, e.g. based on radiated fields (RF)) to the auxiliary device (Aux), at least for receiving and/or transmitting signals ($CNT_R$, $CNT_L$), e.g. control signals, e.g. information signals (e.g. DoA), e.g. including audio signals. The transceivers are indicated by RF-IA-Rx/Tx-R and RF-IA-Rx/Tx-L in the right and left hearing devices, respectively.

Figure 6:
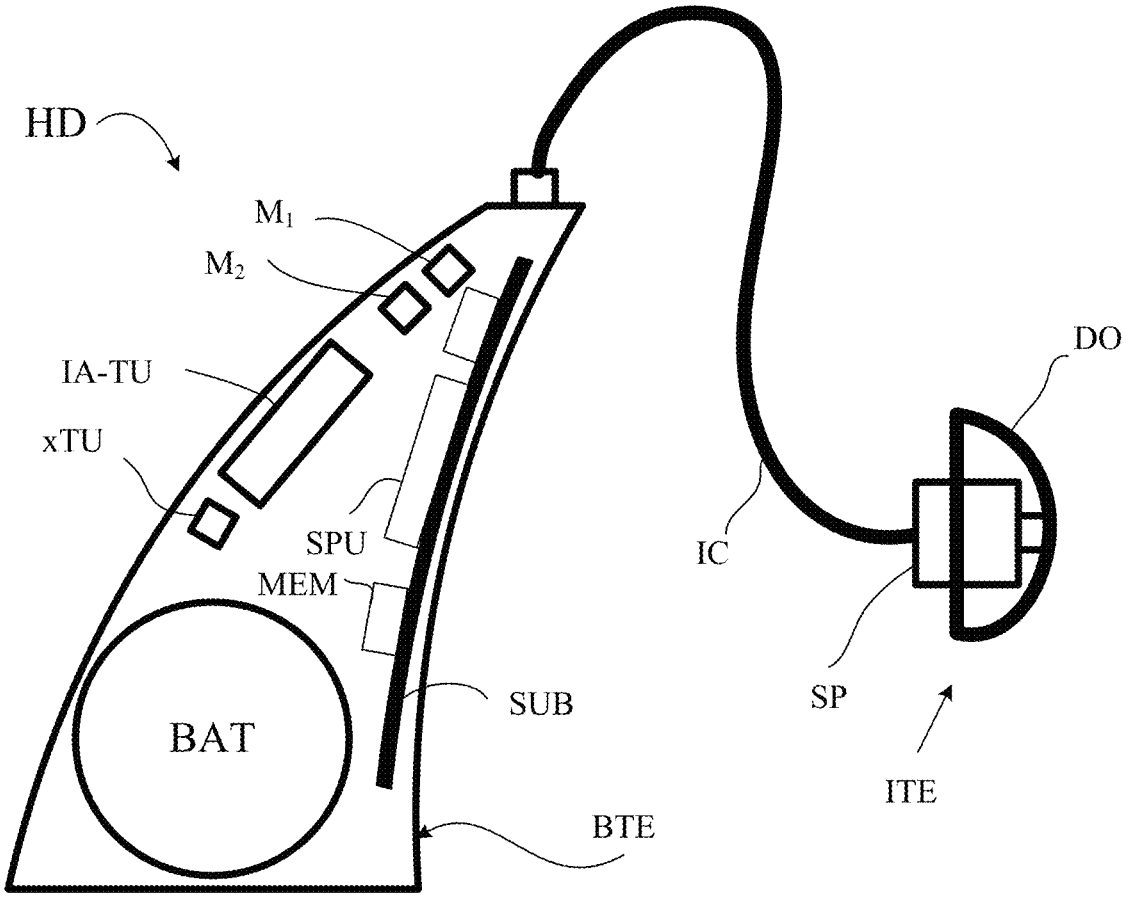
FIG. 6 shows an exemplary (schematic) physical implementation of a hearing device according to the present disclosure.

FIG. 6 shows an exemplary (schematic) physical implementation of a hearing device according to the present disclosure. The hearing device (HD) shown in FIG. 6, e.g. a hearing aid, is of a particular style (sometimes termed receiver-in-the ear, or RITE, style) comprising a BTE-part (BTE) adapted for being located at or behind an ear of a user and an ITE-part (ITE) adapted for being located in or at an ear canal of a user's ear and comprising a receiver (loudspeaker, SP). The BTE-part and the ITE-part are connected (e.g. electrically connected) by a connecting element (IC).

In the embodiment of a hearing device (HD) in FIG. 6, e.g. a hearing aid, the BTE part comprises two input transducers (e.g. microphones) ($M_1$, $M_2$, e.g. corresponding to front and rear microphones, respectively), each for providing an electric input audio signal representative of an input sound signal (e.g. a 'noisy' version of the audio signal). In another embodiment, the hearing device (HD) comprises three or more input transducers (e.g. microphones). The hearing device of FIG. 6 further comprises two wireless transceivers (IA-TU, xTU) for availing reception and/or transmission of respective audio and/or information or control signals. In an embodiment, xTU is configured to receive an essentially noise-free version of the audio signal from the audio sound source (here a TV, see FIG. 1A, 1B, 2), and IA-TU is configured to transmit or receive audio signals (e.g. microphone signals, or (e.g. band-limited) parts thereof) and/or to transmit or receive information (e.g. related to the localization of the audio sound source (e.g. TV in FIG. 5B) and/or a preferred acoustic sound source in the user's environment (e.g. AS in FIG. 5B), e.g. a DoA) from a contralateral hearing device of a binaural hearing system, e.g. a binaural hearing aid system or from an auxiliary device. The hearing device (HD) comprises a substrate SUB whereon a number of electronic components are mounted, including a memory (MEM), e.g. storing default relative transfer functions RTF(k,θ) from a reference microphone to any of the further microphones of the hearing system. The BTE-part further comprises a configurable signal processor (SPU, PRO) adapted to access the memory (MEM) and for selecting and processing one or more of the electric input audio signals and/or one or more of the directly received auxiliary audio input signals, based on a current parameter setting (and/or on inputs from a user interface). The configurable signal processor (SPU, PRO) provides an enhanced audio signal, which may be presented to a user or further processed or transmitted to another device as the case may be.

The hearing device (HD) further comprises an output unit (e.g. an output transducer or electrodes of a cochlear implant) providing an enhanced output signal as stimuli perceivable by the user as sound based on said enhanced audio signal or a signal derived therefrom In the embodiment of a hearing device in FIG. 6, the ITE part comprises the output unit in the form of a loudspeaker (receiver) (SP) for converting an electric signal to an acoustic signal. The ITE-part further comprises a guiding element, e.g. a dome, (DO) for guiding and positioning the ITE-part in the ear canal of the user.

The hearing device (HA) exemplified in FIG. 6 is a portable device and further comprises a battery (BAT), e.g. a rechargeable battery, for energizing electronic components of the BTE- and ITE-parts.

In an embodiment, the hearing device, e.g. a hearing aid (e.g. the signal processor), is adapted to provide a frequency dependent gain and/or a level dependent compression and/or a transposition (with or without frequency compression) of one or more source frequency ranges to one or more target frequency ranges, e.g. to compensate for a hearing impairment of a user.

A hearing system according to the present disclosure may e.g. comprise left and right hearing devices as shown in FIG. 6.

Figure 7:
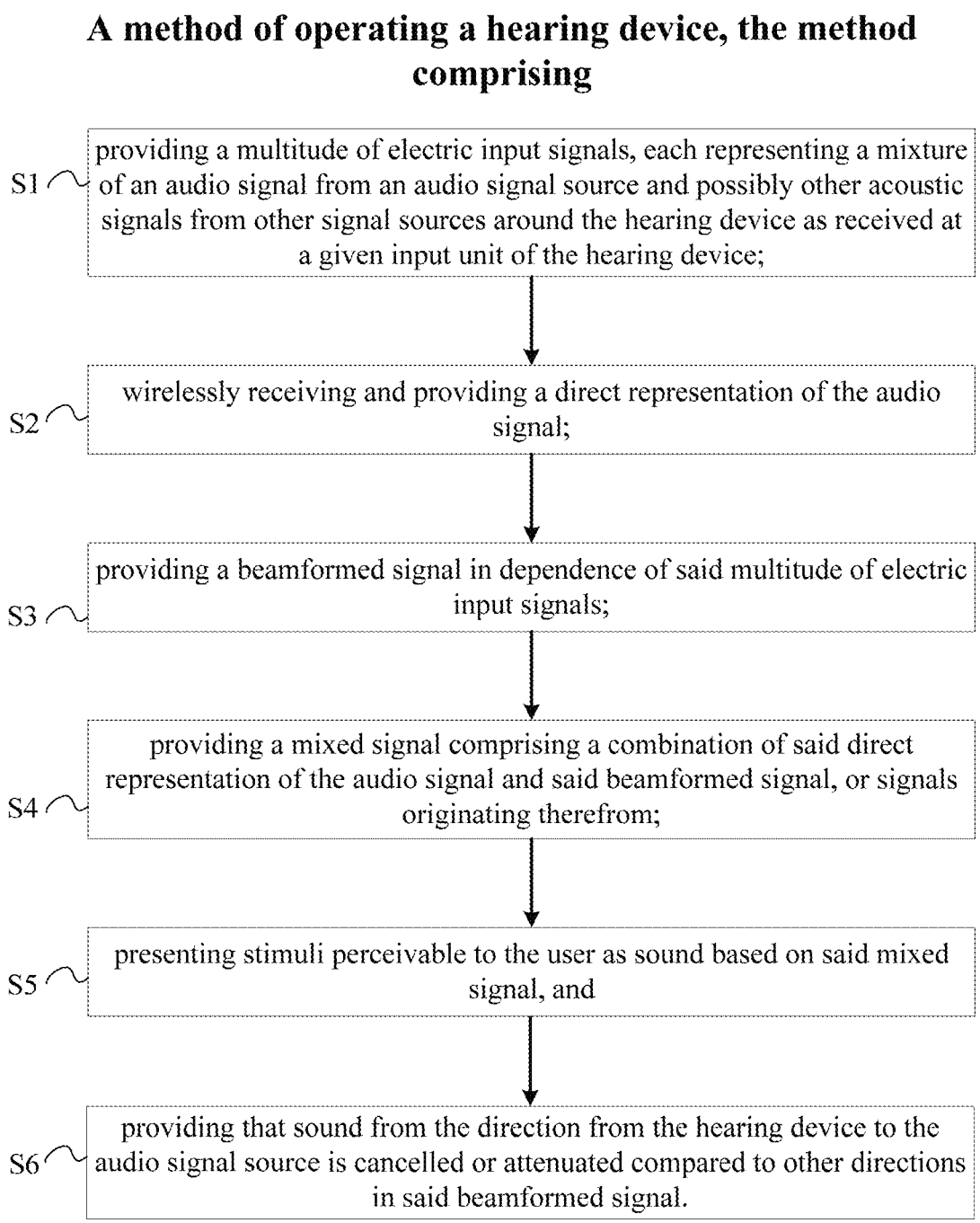
FIG. 7 shows a method of operating a hearing device according to an embodiment of the disclosure, The figures are schematic and simplified for clarity, and they just show details which are essential to the understanding of the disclosure, while other details are left out. Throughout, the same reference signs are used for identical or corresponding parts.

FIG. 7 shows a method of operating a hearing device according to an embodiment of the disclosure/ The hearing device, e.g. a hearing aid, may be adapted for being located at or in an ear of a user and/or for being fully or partially implanted in the head of the user is furthermore provided by the present application. The method comprises S1. providing a multitude of electric input signals, each representing a mixture of an audio signal from an audio signal source and possibly other acoustic signals from other signal sources around the hearing device as received at a given input unit of the hearing device;

S2. wirelessly receiving and providing a direct representation of the audio signal;

S3. providing a beamformed signal in dependence of said multitude of electric input signals;

S4. providing a mixed signal comprising a combination of said direct representation of the audio signal and said beamformed signal, or signals originating therefrom;

S5. presenting stimuli perceivable to the user as sound based on said mixed signal, and S6. providing that sound from the direction from the hearing device to the audio signal source is cancelled or attenuated compared to other directions in said beamformed signal.

Thereby only the wireless version of the perceived sound is maintained in the mixed signal presented to the user.

It is intended that the structural features of the devices described above, either in the detailed description and/or in the claims, may be combined with steps of the method, when appropriately substituted by a corresponding process.

As used, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element but an intervening elements may also be present, unless expressly stated otherwise. Furthermore, "connected" or "coupled" as used herein may include wirelessly connected or coupled. As used herein, the term "and/or" includes any and all combinations of one or more of the associated listed items. The steps of any disclosed method is not limited to the exact order stated herein, unless expressly stated otherwise.

It should be appreciated that reference throughout this specification to "one embodiment" or "an embodiment" or "an aspect" or features included as "may" means that a particular feature, structure or characteristic described in connection with the embodiment is included in at least one embodiment of the disclosure. Furthermore, the particular features, structures or characteristics may be combined as suitable in one or more embodiments of the disclosure. The previous description is provided to enable any person skilled in the art to practice the various aspects described herein. Various modifications to these aspects will be readily apparent to those skilled in the art, and the generic principles defined herein may be applied to other aspects.

The claims are not intended to be limited to the aspects shown herein, but is to be accorded the full scope consistent with the language of the claims, wherein reference to an element in the singular is not intended to mean "one and only one" unless specifically so stated, but rather "one or more." Unless specifically stated otherwise, the term "some" refers to one or more.

Accordingly, the scope should be judged in terms of the claims that follow.

REFERENCES

[Farmani et al.; 2017a] Mojtaba Farmani, Michael Syskind Pedersen, Zheng-Hua Tan, and Jesper Jensen, Informed Sound Source Localization Using Relative Transfer Functions for Hearing Aid Applications, IEEE/ACM TRANSACTIONS ON AUDIO, SPEECH, AND LANGUAGE PROCESSING, VOL. 25, NO. 3, MARCH 2017, pp. 611-623.

[Farmani et al.; 2017b]: Co-pending European patent application no. 17160114.9 filed on 9 Mar. 2017 having the title "A method of localizing a sound source, a hearing device, and a hearing system".

[Brandstein & Ward; 2001] M. Brandstein and D. Ward, Microphone Arrays: Signal Processing Techniques and Applications. Berlin, Heidelberg, Germany: Springer, June 2001.

The invention claimed is:

1. A hearing device adapted for being located at or in an ear of a user and/or for being fully or partially implanted in the head of the user, the hearing device comprising a multitude of input units each providing an electric input signal representing a mixture of an audio signal from an audio signal source and possibly acoustic signals from other acoustic signal sources around the hearing device as received at the input unit in question;

a wireless receiver for receiving and providing a direct representation of the audio signal from the audio signal source;

a beamformer filtering unit configured to receive said multitude of electric input signals, and providing a beamformed signal;

a combination unit for providing a mixed signal comprising a combination of said direct representation of the audio signal and said beamformed signal, or signals originating therefrom;

an output unit for presenting stimuli perceivable to the user as sound based on said mixed signal, wherein the beamformer filtering unit comprises an audio signal cancelling beamformer configured to provide that sound from a direction from the hearing device to the audio signal source is cancelled or attenuated compared to other directions in said beamformed signal.

2. A hearing device according to claim 1 wherein the combination unit is a weighting unit providing the mixed signal as a weighted combination of said direct representation of the audio signal and said beamformed signal, or signals originating therefrom.

3. A hearing device according to claim 1 wherein the beamformer filtering unit comprises an MVDR beamformer.

4. A hearing device according to claim 1 comprising a wireless signal detector configured to detect whether or not, at a given point in time, a wireless direct representation of the audio signal is received by the hearing device, and to provide a detector signal indicative thereof.

5. A hearing device according to claim 1 comprising a control unit for receiving said direct representation of the audio signal and determining or defining a direction from the hearing device to the audio signal source.

6. A hearing device according to claim 1 wherein the beamformer filtering unit comprises an adaptive filter configured to determine a spatial filter that minimizes the correlation between the acoustically propagated sound represented by said electric input signal(s) and the wirelessly received sound represented by said direct representation of the audio signal under the constraint that noise from a direction to another sound source of interest is unaltered.

7. A hearing device according to claim 6 comprising a controller configured to minimize the correlation between the acoustically propagated sound and the wirelessly received sound only, when the wireless signal is being received by the hearing device.

8. A hearing device according to claim 1 comprising a user interface allowing a user to influence a location of or direction to an acoustic signal source of interest to the user other than the audio signal source.

9. A hearing device according to claim 1 comprising a movement sensor for tracking a head movement, or configured to receive data about head movement from another device, and a control unit configured to update beamformer filtering coefficients in dependence of detected head movements.

10. A hearing device according to claim 1 comprising a hearing aid, a headset, an earphone, an ear protection device or a combination thereof.

11. A hearing device according to claim 1 configured to cancel or attenuate said audio signal from said audio signal source in dependence of said direct representation of the audio signal or on an estimate or indication of a direction to said audio signal source.

12. A hearing system comprising left and right hearing devices according to claim 1 and an auxiliary device, wherein the hearing system is adapted to establish a communication link between the hearing devices and the auxiliary device to provide that information, e.g. control and status signals, possibly audio signals, can be exchanged or forwarded from one to the other.

13. A method of operating a hearing device adapted for being located at or in an ear of a user and/or for being fully or partially implanted in the head of the user, the method comprising providing a multitude of electric input signals, each representing a mixture of an audio signal from an audio signal source and possibly other acoustic signals from other signal sources around the hearing device as received at a given input unit of the hearing device;

wirelessly receiving and providing a direct representation of the audio signal;

providing a beamformed signal in dependence of said multitude of electric input signals;

providing a mixed signal comprising a combination of said direct representation of the audio signal and said beamformed signal, or signals originating therefrom;

presenting stimuli perceivable to the user as sound based on said mixed signal; and providing that sound from the direction from the hearing device to the audio signal source is cancelled or attenuated compared to other directions in said beamformed signal.

14. A method according to claim 13 comprising cancelling or attenuating said audio signal from said audio signal source in dependence of said direct representation of the audio signal or on an estimate or indication of a direction to said audio signal source.

15. A data processing system comprising a processor and program code means for causing the processor to perform the method of claim 13.

16. A non-transitory computer readable medium having stored thereon a computer program comprising instructions which, when the program is executed by a computer, cause the computer to carry out the method of claim 13.

17. A non-transitory computer readable medium storing executable instructions configured to be executed on an auxiliary device to implement a user interface for a hearing device according to claim 1.

18. A non-transitory computer-readable medium according to claim 17, wherein said executable instructions are configured to run on a cellular phone, or on another portable device allowing communication with said hearing device or said hearing system.

19. A non-transitory computer-readable medium according to claim 17, wherein said executable instructions are configured to allow a user to select a mode of operation of the hearing device or the hearing system where audio signals streamed to the hearing device(s) is/are mixed with signals from the environment.

20. A non-transitory computer-readable medium according to claim 17, wherein said executable instructions are configured to allow a user to select a manual mode wherein a direction of arrival of a target sound source among the acoustic around sources, other than the audio source, and/or the direction to the audio sound source can be manually selected via a touch sensitive screen.

* * * * *